US009637974B2

(12) United States Patent
Thompson

(10) Patent No.: US 9,637,974 B2
(45) Date of Patent: May 2, 2017

(54) ROLLER DOOR SYSTEM

(71) Applicant: THE SECRETARY OF STATE FOR DEFENCE, Salisbury, Wiltshire (GB)

(72) Inventor: Duncan Godfrey Mervyn Thompson, Salisbury (GB)

(73) Assignee: The Secretary of State for Defence, Salisbury, Wiltshire (GB)

( * ) Notice: Subject to any disclaimer, the term of this patent is extended or adjusted under 35 U.S.C. 154(b) by 0 days.

(21) Appl. No.: 15/032,063

(22) PCT Filed: Oct. 23, 2014

(86) PCT No.: PCT/GB2014/000428

§ 371 (c)(1),
(2) Date: Apr. 26, 2016

(87) PCT Pub. No.: WO2015/063441

PCT Pub. Date: May 7, 2015

(65) Prior Publication Data

US 2016/0258212 A1 Sep. 8, 2016

(30) Foreign Application Priority Data

Oct. 30, 2013 (GB) ..... 1319194.5

(51) Int. Cl.
*E06B 9/64* (2006.01)
*E06B 9/66* (2006.01)
(Continued)

(52) U.S. Cl.
CPC ..... *E06B 9/66* (2013.01); *A62C 2/10* (2013.01); *E04H 15/58* (2013.01); *E06B 9/56* (2013.01);
(Continued)

(58) Field of Classification Search
CPC ..... E06B 9/08; E06B 9/56; E06B 9/60; E06B 9/64; E06B 9/66; E06B 9/68; E04H 15/18; A62C 2/10; A62C 2/248
(Continued)

(56) References Cited

U.S. PATENT DOCUMENTS 3,231,006 A * 1/1966 Fisher ..... E06B 9/13 160/269
4,079,772 A * 3/1978 Klaenhammer ..... E06B 3/285 160/238
(Continued)

FOREIGN PATENT DOCUMENTS

CH 560833 A5 4/1975
CN 202291894 U 4/2012
(Continued)

OTHER PUBLICATIONS

Machine translation of JP, 2009-097139, A from J-PlatPat, trnaslation run Jul. 21, 2016, 13 pages.*
(Continued)

*Primary Examiner* — Robert Canfield
(74) *Attorney, Agent, or Firm* — Dean W. Russell; Kilpatrick Townsend & Stockton LLP

(57) ABSTRACT

A roller door system (100) particularly for opening and closing a doorway (120) defined in the wall of a lightweight structure (110) such as a marquee, hangar, field hospital, emergency shelter and the like. The door system comprises a rollable door (150) secured, in use, along one edge of the doorway (152); a roller (140) for rolling and unrolling the rollable door about the roller; an opening mechanism and a closing mechanism for controlling the deployment of the rollable door by translating the roller across the doorway; and reusable sealing means (135, 136, 155, 156) for sealing between the lateral margins of the rollable door and the doorway; characterized in that the rollable door comprises a
(Continued)

plurality of collapsible hoses (165, 166) connected to a pressurized fluid power system (160, 161, 163) such that in use a positive pressure applied to the fluid power system causes the rollable door to unroll from the roller and controls the deployment of the rollable door.

12 Claims, 4 Drawing Sheets

(51) Int. Cl.

| | |
|---|---|
| ***E06B 9/68*** | (2006.01) |
| ***A62C 2/10*** | (2006.01) |
| ***E04H 15/58*** | (2006.01) |
| ***E06B 9/56*** | (2006.01) |
| ***E06B 9/58*** | (2006.01) |
| ***E06B 9/60*** | (2006.01) |
| *A62C 2/24* | (2006.01) |

(52) U.S. Cl.
CPC ..... *E06B 9/581* (2013.01); *E06B 9/60* (2013.01); *E06B 9/64* (2013.01); *E06B 9/68* (2013.01); *A62C 2/248* (2013.01)

(58) Field of Classification Search
USPC ..... 52/2.14
See application file for complete search history.

(56) References Cited

U.S. PATENT DOCUMENTS

| | | | | | |
|---|---|---|---|---|---|
| 4,357,978 | A * | 11/1982 | Keller | E06B 9/17046 | 160/271 |
| 4,510,986 | A * | 4/1985 | Schwankl | A47H 23/01 | 160/354 |
| 4,802,523 | A * | 2/1989 | Scholten | A47H 23/02 | 160/354 |
| 5,195,594 | A | 3/1993 | Allen et al. | | |
| 5,383,510 | A | 1/1995 | Allen | | |
| 5,566,736 | A * | 10/1996 | Crider | E06B 9/13 | 160/121.1 |
| 5,722,476 | A * | 3/1998 | Lujan-Sanchez | E06B 9/08 | 160/133 |
| 5,752,557 | A * | 5/1998 | Crider | E06B 9/13 | 160/121.1 |
| 5,785,105 | A * | 7/1998 | Crider | E06B 9/13 | 160/243 |
| 5,960,847 | A * | 10/1999 | Crider | E06B 9/13 | 160/121.1 |
| 6,138,739 | A | 10/2000 | Crider et al. | | |
| 6,390,110 | B1 | 5/2002 | Brown | | |
| 6,942,001 | B1 * | 9/2005 | Crider | E06B 9/42 | 160/241 |
| 7,028,742 | B2 * | 4/2006 | Sears | E06B 9/13 | 160/243 |
| 7,735,539 | B2 * | 6/2010 | Nakamura | A62C 2/10 | 160/243 |
| 8,826,963 | B2 * | 9/2014 | Wiegel | B65G 69/003 | 160/23.1 |
| 9,194,178 | B2 * | 11/2015 | Andre de la Porte | E06B 9/13 | |
| 2003/0051829 | A1 * | 3/2003 | Sears | E06B 9/13 | 160/243 |
| 2005/0061452 | A1 * | 3/2005 | Sears | E06B 9/13 | 160/7 |
| 2006/0226103 | A1 * | 10/2006 | Streib | E06B 9/17007 | 211/180 |
| 2009/0008039 | A1 * | 1/2009 | Lambridis | A62C 2/10 | 160/121.1 |
| 2009/0165963 | A1 | 7/2009 | Nakamura et al. | | |

FOREIGN PATENT DOCUMENTS

| | | | |
|---|---|---|---|
| GB | 1130490 | A | 10/1968 |
| GB | 2060744 | A | 5/1981 |
| GB | 2485557 | A | 5/2012 |
| GB | 2520177 | A * | 5/2015 |
| JP | 2009097139 | A | 7/2009 |
| WO | 9535427 | A1 | 12/1995 |
| WO | 03038225 | A1 | 5/2003 |
| WO | 2005066449 | A1 | 7/2005 |

OTHER PUBLICATIONS

United Kingdom Patent Application No. GB 1216842.3, Search Report dated Jan. 10, 2013 for, 6 pages.
United Kingdom Patent Application No. GB 1319194.5, Search Report dated Apr. 8, 2014, 3 pages.
International Patent Application No. PCT/GB2014/000428, International Search Report and Written Opinion dated Jan. 15, 2015, 11 pages.
United Kingdom Patent Application No. GB 1418955.9, Search Report dated Feb. 27, 2015 for, 6 pages.
International Patent Application No. PCT/GB2014/000428, International Preliminary Report on Patentability dated May 12, 2016, 8 pages.

* cited by examiner

ROLLER DOOR SYSTEM

CROSS REFERENCE TO RELATED APPLICATION

This application is the U.S. national phase of International Application No. PCT/GB2014/000428 filed on Oct. 23, 2014, and published in English on May 7, 2015 as International Publication No. WO 2015/063441 A1, which application claims priority to Great Britain Patent Application No. 1319194.5 filed on Oct. 30, 2013, the contents of all of which are incorporated herein by reference.

TECHNICAL FIELD OF THE INVENTION

The invention relates to a roller door system particularly, but not exclusively, suitable for use with tents and other lightweight, temporary or rapidly deployable structures, including, but not limited to: marquees, hangars, field hospitals and emergency shelters. More particularly the roller door system is suitable for sealing an opening to prevent ingress of smoke, contaminated air or particulates into a structure.

BACKGROUND TO THE INVENTION

Roller blinds, shutters and doors of various designs are well known. A simple roller blind, shutter or door comprises a roller mounted above a window, doorway or other opening and a sheet of flexible or slatted material wound onto the roller, which can be deployed into an unwound configuration to cover or close the opening. The opening may be provided with guide channels at either side in order to anchor the sides of the closed blind, shutter or door for increased stability or security. The opening and closing operation can be performed manually, for example using a side chain or cord, or can be motorised, for example by incorporating a motor drive mechanism within the roller.

Roller door systems are designed to allow people and equipment to move quickly through the doorway without obstruction e.g. by keeping the threshold as clear as possible, and without being inconvenient to operate e.g. by being too heavy, too slow or prone to jamming.

In situations where it is necessary to seal an opening against the ingress of smoke, contaminated air or particulates it is known to use a roller door system in which the top of the sheet material is secured to the top of the door frame and the roller itself moves relative to the opening. As the roller moves down over the opening the side edges of the sheet material can be progressively sealed to the door frame, for example by means of magnetic strips or hook and loop material. U.S. Pat. No. 5,383,510 (Allen) discloses an example of such a system.

It is an aim of the invention to provide an improved roller door system particularly, but not exclusively, suitable for use with tents and other lightweight, temporary or rapidly deployable structures, including, but not limited to: marquees, hangars, field hospitals and emergency shelters.

SUMMARY OF THE INVENTION

According to an embodiment of the invention, there is provided a roller door system, for opening and closing a doorway defined in the wall of a structure, comprising a rollable door secured, in use, along one edge of the doorway; a roller for rolling and unrolling the rollable door about the roller; a door opening means and a door closing means for controlling the deployment of the rollable door by translating the roller across the doorway; and reusable sealing means for sealing between the lateral margins of the rollable door and the doorway; characterised in that the door closing means comprises a pressurised fluid power system.

Since the door is rollable it can be easily transported and stored. Furthermore, it may be made from a lightweight flexible woven or non-woven sheet material such as PVC or nylon/polyester thereby minimising bulk and weight. The doorway may be defined by a rigid door frame, for example in a lightweight, temporary or rapidly deployable structure, but the roller door system is particularly suitable for use with tented or flexible structures since a rigid door frame is not required. The doorway may be defined by a flexible door frame which reduces bulk and weight of the whole structure and allows for use on over-pressured tents Advantageously, the pressurised fluid power system comprises a plurality of collapsible hoses associated with the rollable door and configured to cause the rollable door to unroll from the roller when expanded by fluid. The collapsible hoses may be mounted on the surface of the rollable door or may be integral to the thickness of the door and are preferably directed substantially parallel to the direction in which the door is rolled and unrolled, so that filling the collapsible hoses with fluid causes the hoses to expand unrolling the door and driving the roller across the doorway. This arrangement requires few rigid components and therefore has advantages of reduced weight and reduced bulk.

The pressurised fluid power system may be pneumatic or hydraulic depending on the particular application; however a hydraulic system is generally preferred because the relative incompressibility of liquid makes it safer than a high pressure compressed gas system. Since a permanent reservoir of hydraulic oil would increase the bulk, weight and fire risk of the roller door system it may be particularly convenient to use water or a water based solution as the hydraulic fluid. In this case the hydraulic reservoir can be filled on location and emptied before transportation and storage. In particularly cold weather it may be desirable to mix an antifreeze additive into the water.

Whilst the pressurised fluid power system may conveniently be operated by an electric pump an alternative power source such as a battery pack should be provided in case of emergencies. However, in some situations it may be preferred to provide a manually operated pump for emergency use.

A valve is conveniently provided to close the fluid system in order to maintain the door closed configuration so that the pump does not have to run continuously once the door is closed. The valve is opened, thereby releasing the fluid pressure, when it is desired to open the door.

Advantageously, the rollable door when unrolled may overlap the lateral margins of the doorway and is mounted externally with respect to the wall of the structure. The reusable sealing means are provided between the overlapping lateral margins of the door and doorway. Mounting the roller door externally of the structure means that a person can exit the structure in an emergency (e.g. a fire) by simply pushing against the rollable door from the inside to unseal the reusable seals. The rollable door does not, therefore, have to be rolled up around the roller in order for a person to exit the structure quickly when required.

The reusable sealing means preferably provide substantially air-tight seals between the lateral margins of the door and the doorway in order to prevent external contaminants from entering the structure. In certain applications it is known to maintain an over-pressure within a structure by means of blowers and filters. In such applications the flow of air from inside the structure to outside is normally controlled via vents and doorways are expected to be effectively sealed to minimise the escape of air. The door and doorway may be sealed and unsealed from one another whilst closing and opening the door respectively. Preferably, the reusable sealing means comprise flexible magnetic strips. Other reusable sealing means such as zip fasteners or hook and loop fasteners can be used, although it is generally more difficult to achieve substantially air-tight seals. Furthermore, the seal provided by a flexible magnetic strip may be more easily broken by pushing against it in the event of an emergency. The use of flexible magnetic strips does not require any effort on the part of an operator to make the seal, since unrolling the door places the margins of the door and the doorway in sufficiently close proximity for the seal to be automatically made by magnetic attraction. For example, a magnetic strip mounted along the length of the lateral margin of the doorway may magnetically attract and make a seal with a flexible magnetic strip mounted along the length of the appropriate lateral margin of the rollable door. The magnetic strips are made of magnetic materials. Typically, for each reusable seal, one of the magnetic strips is magnetised, and the other one of the magnetic strips is not magnetised. If desired then both strips could be magnetised, with opposite polarity, in order to increase the strength of the seal.

A similar substantially air-tight reusable seal is preferably also provided between the rollable door and a final side or threshold of the doorway to improve the air-tight seal of the fully closed door. Furthermore the rollable door may be secured along the first side of the doorway by a reusable seal, however in some cases it may be desirable for this seal to be more robust and in that case a zip fastener or hook and loop fasteners may be more suitable for securing the rollable door along the first side of the doorway.

The door opening means conveniently comprises at least one spring biased to roll the rollable door about the roller, thereby tending to move the roller into its door open position. The spring constant can be designed to overcome the pressure in the fluid power system in order to roll up the door; for example to evacuate the collapsible hoses, returning fluid to its reservoir; as the door rolls about the roller. Alternatively, a pump may be used to reverse the pressure in the fluid power system so that the spring is only required to separate the reusable seals (unless this must be done manually, for example in the case of zip fasteners) and rollup the door. The at least one spring could be fitted within the roller, however it may be convenient to use rolled ribbons of spring material mounted to the rollable door. Such ribbons could be mounted adjacent, laminated to, or within the collapsible hoses or could form the magnetic strips, so that part of the reusable sealing means also acts as the door opening means. In any case the relative forces applied by the pressurised fluid power system, the reusable seals (unless requiring manual unsealing) and the spring bias must be carefully designed to provide ease of door closure, efficient air-tight seals and safe and controlled door opening.

Advantageously, the roller may be provided with a tether and a toggle at each of its ends, so as to facilitate correct alignment of the rollable door. The toggle may be designed to cooperate with a guide channel provided in the wall of the structure parallel to the lateral sides of the doorway. Accordingly, the roller can move up and down the doorway whilst tethered to the wall, the toggle sliding within the channel. This provides additional support and strength to the system and ensures the correct alignment of the door relative to the doorway. Such a system of tethering is particularly advantageous in situations in which an over-pressure is maintained within the structure, since it ensures that the reusable seals are correctly aligned as the door is closed even if there is bulging at the doorway.

Alternatively, the toggle may be designed to attach to, or act as, the slider of an interlocking fastener, such as, for example, a zip fastener. A first row of zip teeth of the zip fastener may be provided along the lateral sides of the rollable door and a second row of zip teeth may be provided in the wall of the structure parallel to the lateral sides of the doorway, the first and second rows of zip teeth being designed to cooperate with one another. As the roller moves down and up the doorway, the slider engages and disengages the zip fastener. Again, this provides additional support and strength to the system and ensures the correct alignment of the door relative to the doorway. Moreover, a zip fastener can readily be integrated with materials typically used in tented or flexible structures.

According to another embodiment of the invention, there is provided a tent comprising the roller door system as hereinbefore described, wherein the doorway is defined in a flexible wall of the tent. There is no requirement for a rigid door frame so the roller door system according to the invention is well suited to use with lightweight, flexible structures.

BRIEF DESCRIPTION OF THE DRAWING

Embodiments of the invention will now be described by way of example only and with reference to the accompanying drawings, in which.

DETAILED DESCRIPTION

Figure 1:
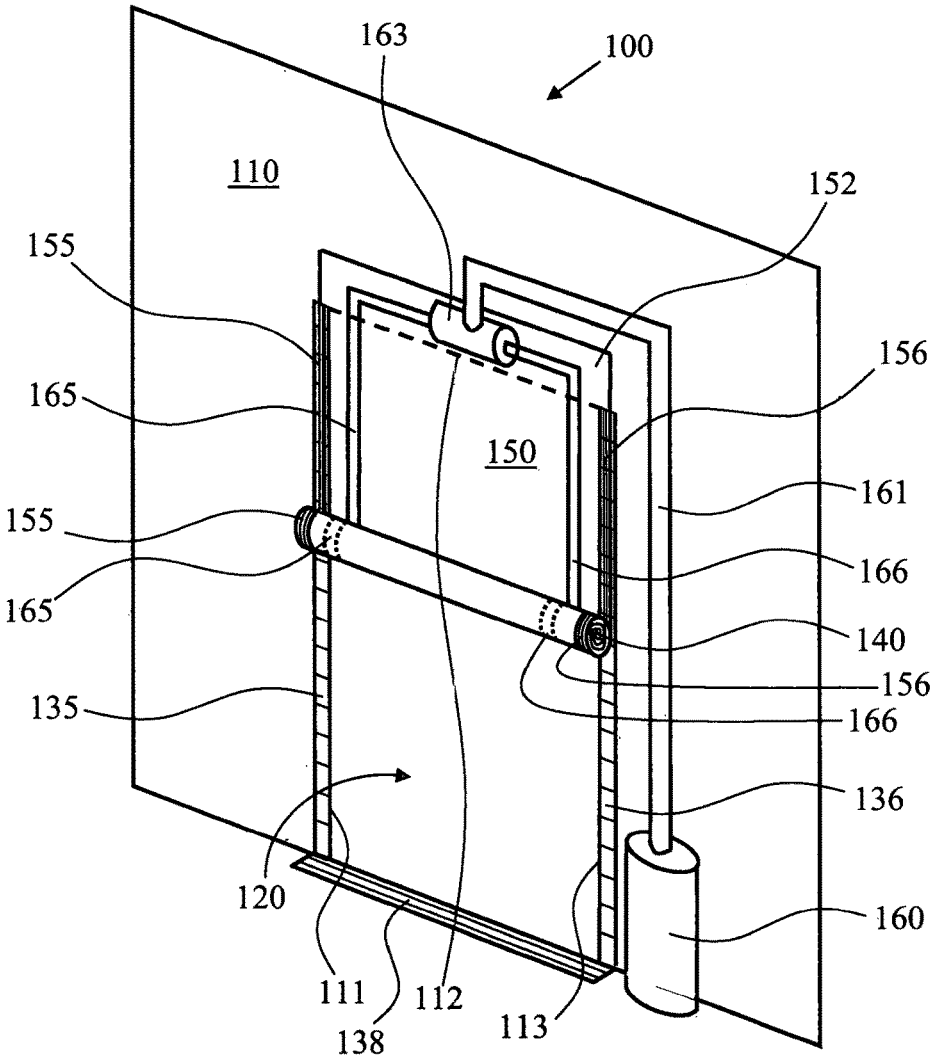
FIG. 1 shows a schematic diagram of a roller door system according to a first embodiment of the invention.

FIG. 1 shows a wall of a temporary emergency shelter including a roller door system 100. The temporary emergency shelter has a wall 110 made from a flexible plastic sheet material having an opening with a left side 111, a top side 112, and a right side 113 which together define a doorway 120 through the plastic sheet wall 110. The plastic sheet wall 110 as shown in FIG. 1 is viewed from outside of the shelter.

The roller door system 100 comprises a rollable door 150 and a roller 140, the roller 140 being attached to the bottom portion of the rollable door 150. A top portion 152 of the rollable door 150 is permanently attached to the plastic sheet wall 110 along the top side 112 of the doorway 120. The rollable door 150 is wider than the doorway 120 and is arranged to overlap the left and right sides 111 and 113 of the doorway 120 on the outer surface of plastic sheet wall 110.

The roller 140 is aligned horizontally across the doorway 120, and is used for rolling and unrolling the rollable door 150 about the roller 140 to respectively open and close the doorway 120. Since the top portion 152 of the rollable door is permanently or semi-permanently attached to the plastic sheet wall 110 along the top side 112 of the doorway 120, rolling and unrolling the roller 140 causes it to be translated up and down the doorway 120 respectively.

The roller door system 100 further comprises left and right side magnetic strips 135 and 136 that are aligned along the left and right sides 111 and 113 of the doorway 120 respectively and that are mounted on the plastic sheet wall 110. Corresponding left and right side magnetic strips 155 and 156 are aligned and mounted along left and right sides of the rollable door 150. As the rollable door 150 is unrolled from the roller 140, the magnetic strips 155 and 156 mounted on the rollable door 150 are attracted to and make an air-tight seal with the magnetic strips 135 and 136 mounted on the plastic sheet 110.

The roller 140 is provided with a magnetic strip (not shown) extending along its length. The magnetic strip on the roller 140 makes an air-tight seal with a threshold magnetic strip 138 when the rollable door 150 is fully unrolled. The threshold magnetic strip 138 is connected to the plastic sheet wall 110 and extends horizontally across the bottom of the doorway 120.

Figure 2:
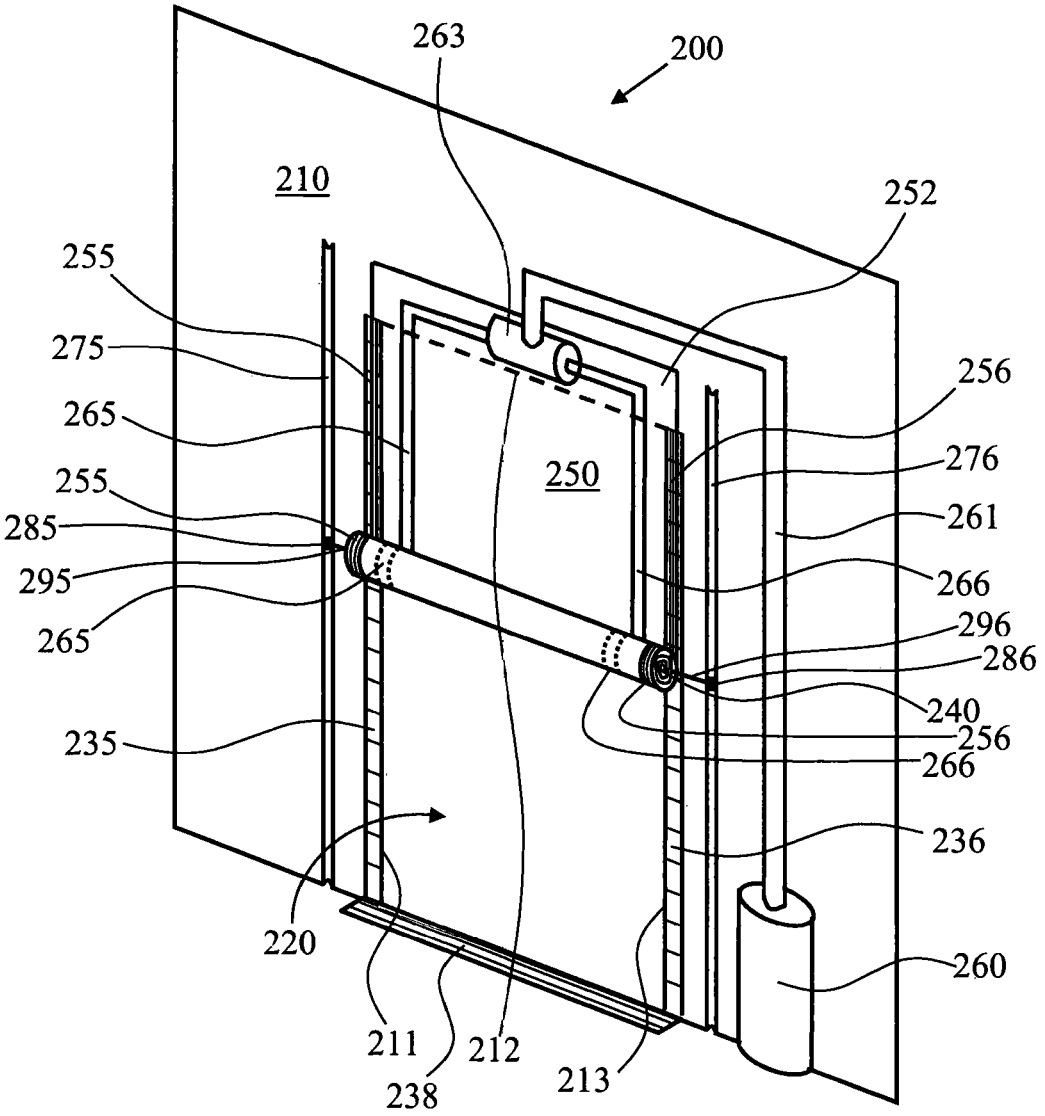
FIG. 2 shows a schematic diagram of a roller door system according to a second embodiment of the invention.

The roller door system 100 is further provided with a hydraulic power system which comprises left and right side collapsible hoses 165 and 166 mounted on the external surface of the rollable door 150 and aligned adjacent the left and right side magnetic strips of spring steel 155 and 156. As shown in FIGS. 1 and 2, these strips of spring steel 155 or 156 (see FIG. 1), or strips 255 or 256 of spring steel (see FIG. 2), may be rollable ribbons, functioning at least in part as springs. The left and right side collapsible hoses 165 and 166 are connected to a hydraulic pumping station 160 via a master hose 161 and a splitter 163. The pumping station 160 includes a hydraulic fluid reservoir and a pump. In this embodiment the hydraulic fluid is water.

A rolled ribbon of spring steel (not shown), such that the spring is relaxed when it is fully rolled up, is inserted in each of collapsible hoses 165 and 166. The balance between the magnetic force exerted by the magnetic strips and the spring constant of the spring steel is carefully designed to ensure that the equilibrium state of the rollable door 150 is its rolled up, raised configuration, however, for safety reasons it is important to ensure that the rollable door 150 does not rewind too quickly when released from its unrolled, lowered configuration. Therefore, in the absence of any other forces acting upon the rollable door 150, the left and right side ribbons of spring steel will cause the rollable door 150 to roll up around the roller 140 moving the roller 140 to its raised position adjacent the top side 112 of the doorway 120, thereby maintaining an open doorway 120.

Figure 3:
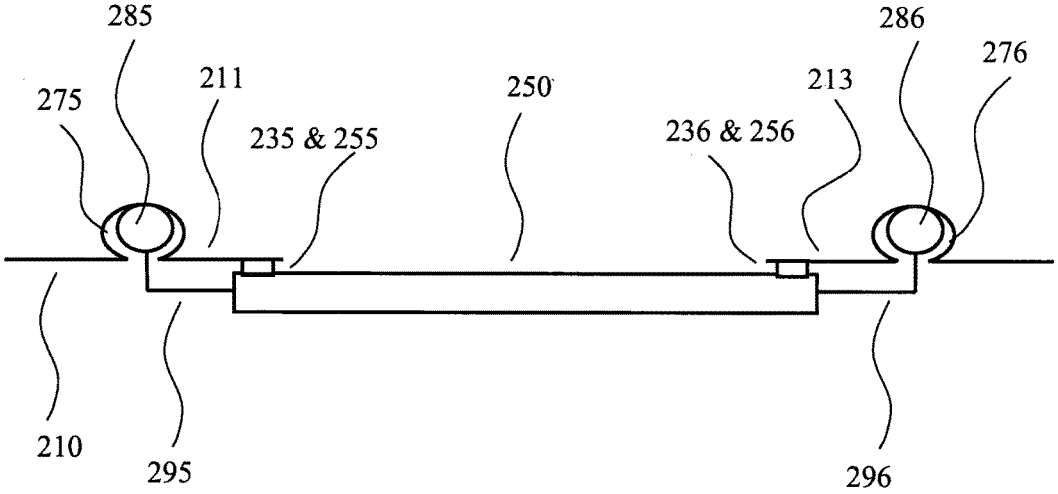
FIG. 3 shows a schematic diagram of a plan view of the second embodiment of the invention; The drawings are for illustrative purposes only and are not to scale.
Figure 4:
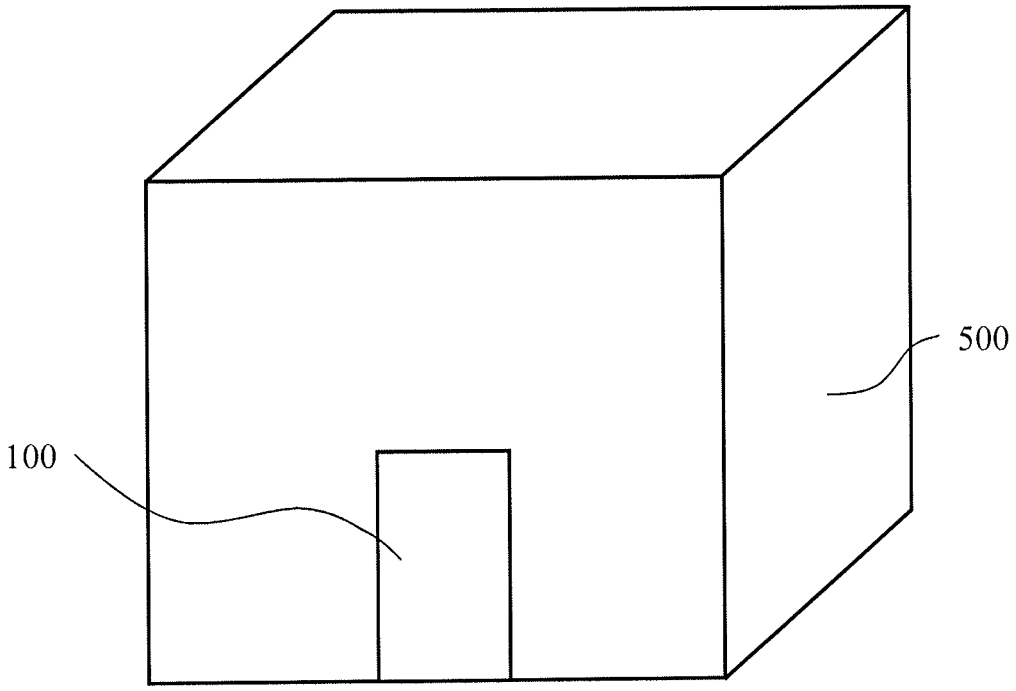
FIG. 4 shows a schematic diagram of a roller door system in the doorway of a tent.

FIG. 2 and FIG. 3 show an alternative embodiment of a roller door system 200. Wall 210 made from a flexible plastic sheet material has an opening with a left side 211, a top side 212, and a right side 213 which together define a doorway 220. FIG. 2 also shows the external view of the roller door system.

The roller door system 200 comprises a rollable door 250 and a roller 240, the roller 240 being attached to the bottom portion of the rollable door 250. A top portion 252 of the rollable door 250 is permanently or semi-permanently attached to the plastic sheet wall 210 along the top side 212 of the doorway 220. The rollable door 250 is wider than the doorway 220 and is arranged to overlap the left and right sides 211 and 213 of the doorway 220 on the outer surface of plastic sheet wall 210.

The roller 240 is aligned horizontally across the doorway 220, and is used for rolling and unrolling the rollable door 250 about the roller 240 to respectively open and close the doorway 220. Since the top portion 252 of the rollable door is permanently attached to the plastic sheet wall 210 along the top side 212 of the doorway 220, rolling and unrolling the roller 240 causes it to be translated up and down the doorway 220 respectively.

The roller door system 200 further comprises left and right side magnetic strips 235 and 236 that are aligned along the left and right sides 211 and 213 of the doorway 220 respectively and that are mounted on the plastic sheet wall 210. Corresponding left and right side magnetic strips 255 and 256 are aligned and mounted along left and right sides of the rollable door 250. As the rollable door 250 is unrolled from the roller 240, the magnetic strips 255 and 256 mounted on the rollable door 250 are attracted to and make an air-tight seal with the magnetic strips 235 and 236 mounted on the plastic sheet 210.

The roller 240 is provided with a magnetic strip (not shown) extending along its length. The magnetic strip on the roller 240 makes an air-tight seal with a threshold magnetic strip 238 when the rollable door 250 is fully unrolled. The threshold magnetic strip 238 is connected to the plastic sheet wall 210 and extends horizontally across the bottom of the doorway 220.

The roller door system 200 is further provided with a hydraulic power system which comprises left and right side collapsible hoses 265 and 266 mounted on the external surface of the rollable door 250 and aligned adjacent the left and right side magnetic strips of spring steel 255 and 256. The left and right side collapsible hoses 265 and 266 are connected to a hydraulic pumping station 260 via a master hose 261 and a splitter 263. The pumping station 260 includes a hydraulic fluid reservoir and a pump. In this embodiment the hydraulic fluid is water.

A rolled ribbon of spring steel (not shown), such that the spring is relaxed when it is fully rolled up, is inserted in each of collapsible hoses 265 and 266. The balance between the magnetic force exerted by the magnetic strips and the spring constant of the spring steel is carefully designed to ensure that the equilibrium state of the rollable door 250 is its rolled up, raised configuration, however, for safety reasons it is important to ensure that the rollable door 250 does not rewind too quickly when released from its unrolled, lowered configuration. Therefore, in the absence of any other forces acting upon the rollable door 250, the left and right side ribbons of spring steel will cause the rollable door 250 to roll up around the roller 240 moving the roller 240 to its raised position adjacent the top side 212 of the doorway 220, thereby maintaining an open doorway 220.

The roller 240 is provided with a tether such as an extension shaft 295, 296 and a toggle such as a roller bearing 285, 286 at each of its ends. The roller bearings 285, 286 are designed to cooperate with guide channels 275, 276 provided in the wall 210 parallel to the sides of the doorway. Roller bearings 285, 286 slide freely within the guide channels 275, 276 as the roller 240 moves up and down the doorway. This ensures that the door 250 remains correctly aligned with respect to the magnetic strips 235, 236 at all times. Furthermore, this tether system provides additional support and strength to the roller door which is particularly advantageous in situations in which an overpressure is maintained within the structure.

FIG. 3 shows a plan view of the roller door system of the second embodiment (the pressurised fluid system not being shown).

In use the rolling and unrolling of the door is controlled by how much water the pumping station 160, 260 pumps into the collapsible hoses 165, 265 and 166, 266. Pumping water into the collapsible hoses 165, 265 and 166, 266 overcomes the bias of the spring steel causing the rollable door 150, 250 to unroll and move the roller 140, 240 in a downwards direction across the doorway 120, 220. As the rollable door 150, 250 is unrolled from roller 140, 240 the magnetic strips 155, 255 and 156, 256 mounted on the rollable door 150, 250 are attracted to and make an air-tight seal with the magnetic strips 135, 235 and 136, 236 mounted on the flexible shelter wall 110, 210.

The hydraulic pressure in the collapsible hoses can be maintained by means of a valve (not shown) in the hydraulic system. This means that the pump does not have to operate continuously once the door is closed. The valve is opened, thereby releasing the hydraulic pressure, when the door is about to be opened.

When the pumping station 160, 260 pumps water out of the collapsible hoses 165, 265 and 166, 266 the bias of the spring steel causes the rollable door 150, 250 to roll up around the roller 140, 240, thereby separating the magnetic strips 135, 136 or 235, 236 and corresponding magnetic strips 155, 156 or 255, 256 from one another breaking the magnetic seals as it does so, and moving the roller 140, 240 to its raised position adjacent the top side 112, 212 of the doorway 120, 220, thereby opening the doorway 120, 220.

When the doorway 120, 220 is closed by the rollable door 150, 250 and a person requires a fast exit from the shelter, the person may push against the rollable door 150, 250 to separate the magnetic strips 135, 136 or 235, 236 and corresponding magnetic strips 155, 156 or 255, 256 from one another, to open the doorway without raising the roller.

Further embodiments falling within the scope of the appended claims will also be apparent to those skilled in the art. For example although the door system has been described in relation to a temporary emergency shelter, the door system may also find use in other applications such as tent 500.

The invention claimed is:

1. A roller door system, for opening and closing a doorway defined in the wall of a structure, comprising a rollable door (a) having a bottom portion and (b) secured, in use, along a top side of the doorway; a roller attached to the bottom portion of the rollable door for rolling and unrolling the rollable door about the roller; a door opening means and a door closing means for controlling the deployment of the rollable door by translating the roller across the doorway; and reusable sealing means for sealing between the lateral margins of the rollable door and the doorway; and wherein the door closing means comprises a pressurised fluid power system comprising a plurality of collapsible hoses associated with the rollable door and configured to cause the rollable door to unroll from the roller when expanded by fluid.

2. A roller door system as claimed in claim 1 wherein the pressurised fluid power system is a hydraulic system comprising hydraulic fluid.

3. A roller door system as claimed in claim 2 wherein the hydraulic fluid comprises water.

4. A roller door system as claimed in claim 1 wherein the pressurised fluid power system comprises a manually operated pump.

5. A roller door system as claimed in claim 1, wherein the rollable door overlaps the lateral margins of the doorway and wherein the reusable sealing means are provided between the overlapping lateral margins of the rollable door and the doorway.

6. A roller door system as claimed in claim 1 wherein the reusable sealing means comprise flexible magnetic strips.

7. A roller door system as claimed in claim 1 wherein the door opening means comprises at least one spring biased to roll the rollable door about the roller.

8. A roller door system as claimed in claim 7 wherein the rollable door comprises a plurality of rolled ribbons of spring material.

9. A roller door system as claimed in claim 1 wherein the roller comprises a tether and toggle at each of its ends.

10. A roller door system as claimed in claim 9 wherein the toggle is designed to cooperate with a guide channel provided in the wall of the structure parallel to the lateral sides of the doorway.

11. A roller door system as claimed in claim 9 wherein the toggle is attached to or acts as the slider of an interlocking fastener.

12. A tent comprising the roller door system of claim 1, wherein the doorway is defined in a flexible wall of the tent.

* * * * *